United States Patent [19]

Fekete et al.

[11] 4,098,870

[45] Jul. 4, 1978

[54] ACID LEACHING OF NICKELIFEROUS OXIDE ORES WITH MINIMIZED SCALING

[75] Inventors: Simon O. Fekete, Arvada; Gordon R. Wicker, Lakewood; Willem P. C. Duyvesteyn, Arvada; Dien F. Shieh, Lakewood, all of Colo.

[73] Assignee: Amax Inc., Greenwich, Conn.

[21] Appl. No.: 818,130

[22] Filed: Jul. 22, 1977

[51] Int. Cl.[2] ..... C01G 53/10

[52] U.S. Cl. ..... 423/124; 423/142; 423/150

[58] Field of Search ..... 423/123, 140, 124, 141, 423/142, 150; 75/101 R, 115, 119

[56] References Cited

U.S. PATENT DOCUMENTS

| | | | |
|---|---|---|---|
| 3,773,891 | 11/1973 | O'Neill | 423/139 |
| 3,809,549 | 5/1974 | Opratko | 75/115 |
| 3,991,159 | 11/1976 | Queneau et al. | 423/141 |
| 4,044,096 | 8/1977 | Queneau et al. | 423/150 |

OTHER PUBLICATIONS

Boldt et al., The Winning of Nickel, Longmans Canada Ltd., Toronto, (1967), pp. 437–446.

*Primary Examiner*—Brian Hearn
*Attorney, Agent, or Firm*—Michael A. Ciomek

[57] ABSTRACT

Nickel values contained in oxidic ores are recovered by leaching with sulfuric acid. The ore is slurried with water, preheated to a leaching temperature between about 230° C and about 300° C and the preheated slurry is fed to one or more vigorously agitated autoclaves, operating continuously in series. Sulfuric acid is added incrementally to the preheated slurry to minimize the amount of iron and aluminum in solution until between about 0.15 part and about 0.8 part of acid per part of dry ore is added to the slurry, thereby minimizing the deposition of scale in the autoclaves.

16 Claims, 2 Drawing Figures

ACID LEACHING OF NICKELIFEROUS OXIDE ORES WITH MINIMIZED SCALING

FIELD OF THE INVENTION

The present invention relates to the hydrometallurgical treatment of nickeliferous oxide ores and, more particularly, to the acid leaching of such ores.

BACKGROUND OF THE INVENTION

Nickeliferous oxide ores, i.e. nickeliferous limonites and nickeliferous silicates, are the world's largest potential sources of nickel and cobalt. The inability to beneficiate these ores by conventional techniques, such as froth flotation or magnetic separation, has placed these ores at an economic disadvantage as compared to sulfide ores which can be concentrated by well known means.

One process for recovering nickel and cobalt from oxide ores is that practiced in Cuba at Moa Bay. The Moa Bay process involves acid leaching at elevated temperatures sufficiently high that the sulfates of aluminum and iron are substantially insoluble. A recurring problem with this process is the build-up of scale on all reactor parts exposed to the acidified slurry. As the scale builds up, the capactiy of the autoclave is lowered and eventually processing must be terminated for scale removal.

in U.S. Pat. Nos. 3,773,891 and 3,809,549 and in U.S.S.R. Pat. No. 256,264 there are disclosed processes for leaching nickel from oxidic ores by oxidizing pyrites to form sulfuric acid in situ. In order to take advantage of the exothermic nature of the pyrites oxidation, the slurry of nickeliferous oxide ore and pyrites is preheated to a temperature sufficient to initiate the oxidation reactions and the slurry is thereafter heated to the leaching temperature by the heat released by the oxidation of pyrites. The U.S. patentees state that the comparatively mild leaching conditions reduce scale formation. The effective increase in capacity realised by extending the time between shutdowns for scale removal is more than offset, however, by the increase in residence time that is required for the complete oxidation of pyrites and the effective decrease in capacity by the pyrites displacing a portion of the ore. Other drawbacks of these processes are the additional amount of piping and control mechanisms that are required to maintain proper partial pressures of oxygen for pyrite oxidation. The additional piping and control devices increase both capital and operating costs. An even further problem with these processes is that in order to maintain your requisite partial pressures of oxygen the atmosphere over the slurry must be continuously exhausted so that even though the oxidation of pyrites is exothermic the need for exhausting the atmosphere renders the overall process endothermic.

SUMMARY OF THE INVENTION

The present invention relates generally to the acid leaching of nickeliferous oxide ores also containing at least one metal selected from the group consisting of iron and aluminum. The oxide ore is slurried with water and is preheated to a leaching temperature between about 230° C and 300° C. Sulfuric acid is added incrementally to the preheated slurry and the slurry is vigorously agitated to minimize free acid concentration and temperature gradients caused by the sulfuric acid additions whereby dissolution and hydrolysis of aluminum or iron are controlled. Under these conditions, nickel values are rapidly leached while scale formation is minimized.

DETAILED DESCRIPTION

Figure 1:
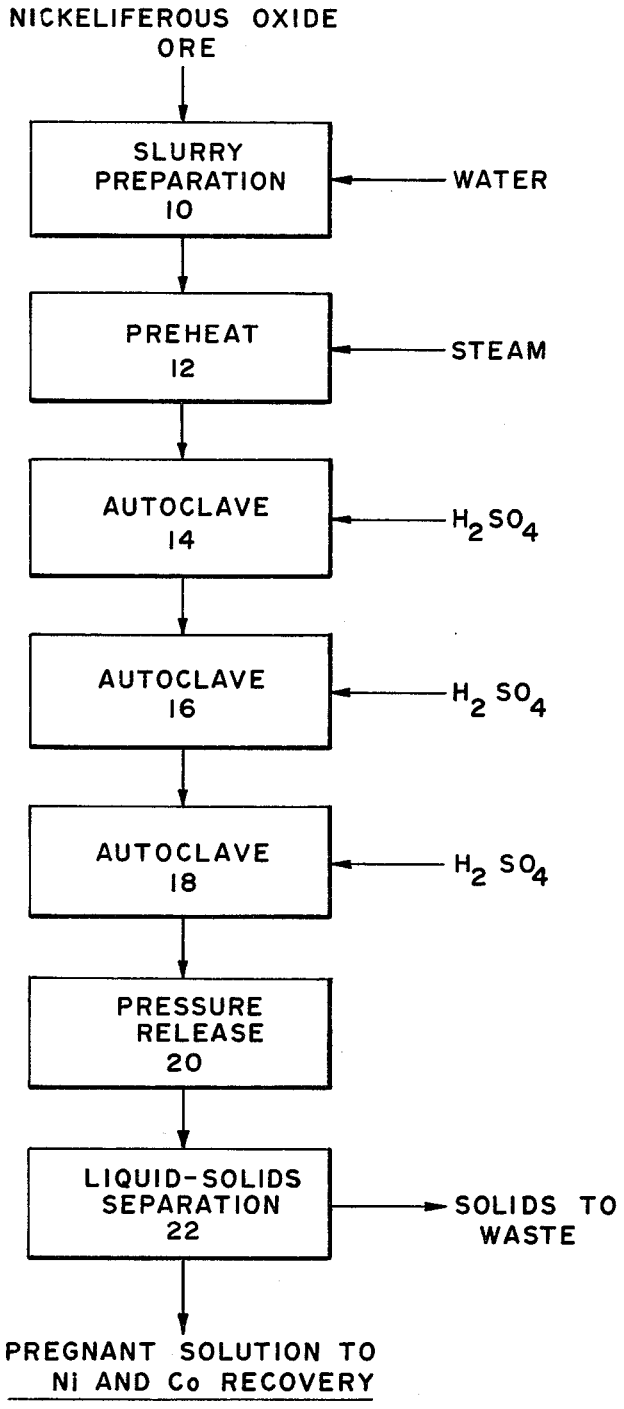
FIG. 1 is a flowsheet of the process in accordance with the present invention.

Referring to FIG. 1, nickeliferous oxide ore is fed continuously to slurry preparation 10 where sufficient water is added to provide a pulp density of between about 20% solids and about 50% solids. The slurry is then sent to preheating vessels 12 in which the slurry is preheated to a leaching temperature between about 230° C and about 300° C, advantageously between about 250° C and about 300° C. Preheating can be direct by injecting steam into the slurry or indirect by using heat exchangers. The preheated slurry is fed to autoclave 14 into which between about 40% and about 80% of the total amount of sulfuric acid that is to be utilized in the overall process is added while the slurry is vigorously agitated to minimize free acid concentration and temperature gradients caused by the sulfuric acid additions. Slurry from autoclave 14 is continuously fed to autoclave 16 and then to autoclave 18 with the remainder of the sulfuric acid being added to autoclaves 16 and 18 in amounts and together with vigorous agitation to control the dissolution and hydrolysis of iron and/or aluminum. The reacted slurry effluent is let down to atmospheric conditions in stage 20 so that the pregnant solution can be separated from the leach residue in stage 22 and treated for nickel recovery. During pressure letdown, steam is recovered for recycling to the preheating stage.

All nickeliferous oxide ores, including nickeliferous deep sea nodules, can be treated by the process in accordance with the present invention. Cobalt is invariably present with the nickel and is co-extracted during leaching. It will be understood that all references to nickel herein also include cobalt. If the ore is a mixture of nickeliferous limonite and silicate, the nickeliferous limonite, which naturally occurs as over 80% minus 325 mesh (Tyler screen size), can be separated from the silicate fraction, which naturally occurs as plus 20 mesh, by wet screening techniques. The limonite fraction can be thickened and acid leached as described hereinbefore and the silicate fraction can be used to neutralize partly the pregnant nickel-containing solution. If the bulk of the ore is silicate, the ore is crushed to 100% minus 30 mesh to insure stable slurries and improved leaching kinetics.

The nickeliferous oxide ore is formed into an aqueous slurry containing between about 20% and about 50% solids and advantageously between about 40% and about 45% solids. If the ore was formed into a dilute slurry for transportation from the mining site, the pulp density of the slurry is adjusted by using conventional slurry thickeners. Slurries containing greater or lesser amounts of solids can be employed but slurries containing solids within the foregoing ranges provide stable slurries, minimize materials handling problems, insure high rates of reaction and insure efficient utilization of autoclave capacity.

An important aspect of the present invention is the control of both acid concentration and temperature gradients in the slurry. Scale formation is accelerated by the presence of steep compositional and thermal gradients. A given acid concentration at a one temperature will dissolve significant portions of the iron and aluminum in the nickeliferous oxide and as the temperature of the slurry is raised a portion of the dissolved iron and/or aluminum is hydrolyzed, forming scale. Under the conditions encountered in leaching nickeliferous oxide ores, the amount of aluminum in solution is more sensitive to temperature variations than is iron. Likewise, at a given temperature the amounts of iron and aluminum in solution increase as the acid concentration increases. As the acid is consumed by the constituents in the ore, the acid concentration decreases hydrolyzing significant amounts of dissolved iron and aluminum. Scale formation is more dependent upon acid concentration and temperature gradients, both spatial and temporal but most importantly spatially, than on the absolute magnitude of these factors. Scale formation can thus be minimized by controlling both temperature and acid concentration gradients. Control of the acid concentration and temperature gradients, which are caused by the sulfuric acid additions, is achieved by incremental acid additions and vigorous agitation.

An important feature of the present invention is the preheating of the slurried ore to the leaching temperature before any acid is added to the slurry. When acid is added before or during preheating, substantial amounts of aluminum and iron are dissolved. As the slurry approaches 230° C, significant quantities of the dissolved aluminum and iron values are rejected from solution thereby promoting scale formation. By withholding the acid addition until the slurry is heated to the leaching temperature, excessive amounts of iron and aluminum are not dissolved at the lower temperatures to be subsequently precipitated at the higher leaching temperature.

A further important feature of the present invention is that high leaching temperatures up to 300° C can be employed. Such high leaching temperatures increase substantially the rate at which nickel values are leached. High leaching temperatures are also effective in minimizing scale formation. The solubility of aluminum at 300°C is many times less than at 250° C so that when acid is added at 300° C the absolute amount of aluminum in solution is sufficiently small that the amount of dissolution and hydrolysis occurring is minor. Staged acid addition, vigorous agitation and higher temperatures synergistically cooperate with each other to provide low scaling rates and high leaching rates.

An even further feature of the present invention is that when the process is conducted in two or more serially connected autoclaves the amount of the incremental acid additions to the different autoclaves can be varied with time to provide more uniform scale formation in each of the autoclaves. This mode of operation allows the scale to form on all the autoclave walls before shutting down for scale removal, thereby extending the production run by a factor nearly equal to the number of staged acid additions. When acid is added all at once, most of the scale is formed in the first two reactors, the production run must then be terminated when the capacity of only the first two autoclaves become too small, i.e. the first two autoclaves are the weakest link in the chain.

Another important feature of the present invention is the staged addition of sulfuric acid to the preheated slurry of the nickeliferous oxide ore. When acid is added to the slurry, in a single stage, high acid concentration and temperature gradients are initially established in that stage and dissolution of iron and aluminum is excessive in those zones of high acid concentration. As the leaching reactions proceed, previously dissolved iron and/or aluminum are rejected from solution as acid is consumed and as zones of high acid concentration are gradually destroyed as the slurry flows from stage to stage. Incremental acid additions minimize such variation in acidity by adding the acid at approximately the rate it is being consumed by the leaching reactions. By controlling the rate of precipitation of iron and aluminum, a greater proportion of this precipitation occurs on slurry particles, rather than on autoclave surfaces.

The total amount of acid to be added to the slurry during the leaching operation is determined as a function of ore composition and leaching conditions. Nickeliferous silicate ores, which are characterized by high magnesia contents, consume two to three times more acid than limonitic ores, which are characterized by high iron contents. Nickeliferous silicate ores having iron contents as lwo as 7% require acid additions of between about 0.45 part and about 0.8 part of sulfuric acid per part of dry ore. Limonitic ores having iron contents as high as 55% require acid additions of between about 0.15 part and about 0.3 part for each part of dry ore. Nickeliferous oxide ores having intermediate iron contents require proportionate acid additions.

Once the total amount of acid to be added to the slurried ore is determined, the acid is added to the preheated slurry in increments and with vigorous agitation of the slurry such that temperature and free acid concentration gradients are minimized; whereby the precipitation of iron and aluminum is at a controlled rate at the leaching temperature. When acid is added to the slurry, numerous complex and competing chemical reactions occur which are controlled by both equilibrium and kinetic considerations. Some of the metals dissolve rapidly when the acid is added to the slurry, but hydrolyze as the acid is consumed, while less kinetically reactive metals dissolve as acid is released during such hydrolysis.

Because the mineralogical nature and composition of nickeliferous lateritic ores vary from deposit to deposit, it is difficult to quantity the increments to be added at each stage. As a starting point, however, a three stage addition process can be assumed with between about 40% and about 70% of the total amount of acid added to the first stage, up to about 30% of the total amount of acid being added to the second stage and the remainder of the acid being added to the third stage. More specifically, the ranges of acid addition for the first, second and third stage are advantageously between about 50% and about 70%, between about 5% and about 20% and between about 10% and about 50%, respectively, for silicate ores having iron contents as low as about 7% and between about 40% and about 60%, between about 20% and about 30% and between about 10% and about 40%, respectively, for limonitic ores having iron contents as high as about 55%. For mixtures of silicate and limonitic ores the staged acid additions are adjusted within the foregoing ranges depending upon the relative properties of the silicate and limonitic minerals in the mixed ore. Incremental additions within the foregoing ranges will generally minimize scale formation while insuring rapid and complete dissolution of nickel values contained in the ore. However, when scale formation is not lowered by addition within the foregoing ranges the proper incremental additions can be ascertained by controlling the additions to minimize variations in the slurry temperature and in the free acid concentration by analyzing the leach solution to determine those additions that will maintain the aluminum content of the solution below about 4 grams per liter (gpl) and advantageously less than about 1 gpl.

Advantageously, the process in accordance with the present invention is conducted upon a continuous basis in a train of two or more autoclaves with the incremental acid additions being made to at least two of the autoclaves in the train. The number of autoclaves in a train is selected to provide sufficient staging for efficient leaching. In most instances, 3 or more, e.g. 5 or 6, autoclaves are used to optimize leaching efficiencies and capital and operating costs. The average residence times of the slurry in each autoclave when operated in the foregoing manner is between about 3 minutes and about 15 minutes and in most instances between about 5 minutes and about 7 minutes, with a total residence time of between about 15 minutes and about 60 minutes in all the autoclaves. Thus, the process in accordance with the present invention effectively increases autoclave capacity by a factor of three or more as compared to prior art processes relying on pyrite oxidation. One reason that greatly improved throughput rates are realized is that the staged acid addition plus the temperature control allows the use of leaching temperatures heretofore thought impractical because of the scaling problems that would otherwise have been encountered.

An advantageous feature of the present invention is that although the staged addition of sulfuric acid effectively moderates leaching conditions there is no adverse effect on the extent of nickel extraction. Practice of the process in accordance with the present invention in most instances provides nickel extractions in excess of 90% of the nickel contained in the ore and frequently provides nickel extractions of 95% or more at commercially attractive throughput rates while scale formation is minimized.

Another important feature of the present invention is the agitation of the slurry during the leaching reaction period, with vigorous agitation at points of acid addition. At any point of acid addition, there must be a zone of high acid concentration as compared to the acid concentration of the overall slurry (i.e. a steep acid concentration gradient is established), and excessive dissolution of iron and/or aluminum occur in those zones. To minimize this excessive dissolution, it is necessary to minimize the volume of the high-acid zone. These zones or volumes of high acid concentration and high temperatures can be minimized by vigorous agitation. Addition of acid to the slurry causes temperature gradients due to the heat of solution of sulfuric acid. Thus, at points of acid addition zones of higher temperatures exist. As heat is transferred from this high temperature zone to the remainder of the slurry the temperature of the slurry is raised thereby lowering the solubilities of iron and aluminum causing further hydrolysis of iron and/or aluminum. The effectiveness of the agitation in minimizing such gradients can be determined by measuring the iron and/or aluminum contents of the pregnant solution in the same manner as described for the determination of staging additions.

Figure 2:
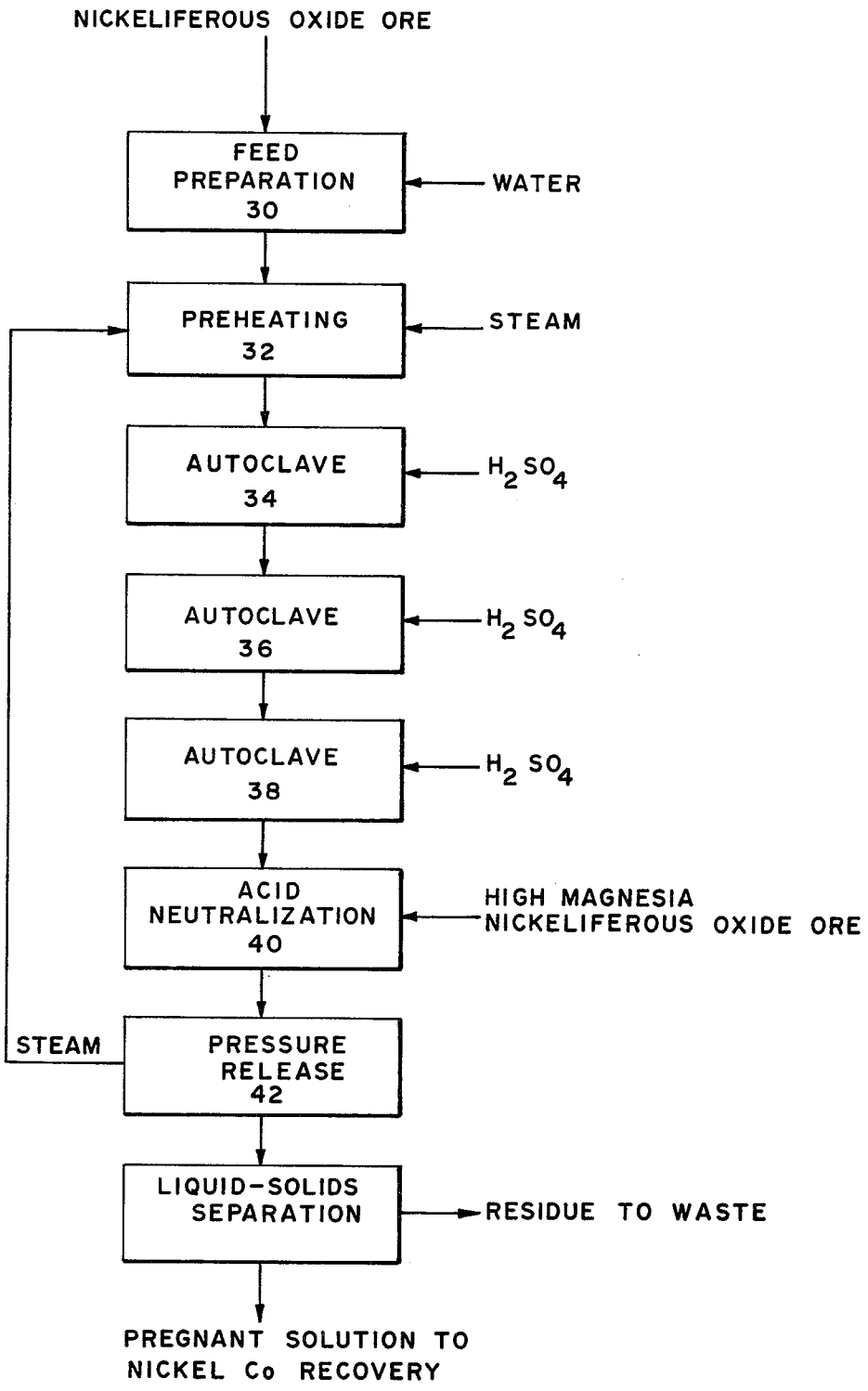
FIG. 2 is a flowsheet of a preferred embodiment of the process in accordance with the present invention.

FIG. 2 is a flowsheet that depicts a preferred embodiment of the present invention. Nickeliferous oxide ore is fed to feed preparation 30 where it is formed into a slurry containing between about 20% solids and 50% solids. The slurry is then sent to preheaters 32 where steam is added to the slurry to preheat the slurry to a leaching temperature between about 230° C and 300° C. The preheated slurry is fed to the train of gravity-fed autoclaves 34, 36 and 38 or to a single autoclave having internal baffles which act to form separate internal stages that act as a series of individual autoclaves. Each of the autoclaves or stages is provided with a stirrer so that the slurry can be vigorously agitated. Sulfuric acid in the total amounts as described hereinbefore is added incrementally as also described hereinbefore to minimize free acid concentration and temperature variations which effectively minimizes the amounts of iron and/or aluminum dissolved in the aqueous phase of the slurry. By the time the slurry has passed through autoclave 38 at least about 90% of the nickel has been extracted from the nickeliferous oxide ore to form a pregnant solution containing nickel, cobalt, magnesium, free acid and minor amounts of iron, aluminum and chromium.

The slurry of pregnant solution and leached residue is advantageously passed to reaction vessel 40 where fresh ore having a high magnesia content or other neutralizing reagent is added to neutralize the free acid contained in the pregnant solution. Upon completion of the neutralization reactions, the slurry pressure is reduced in stage 42 to reduce the slurry temperatures and to recover available energy as steam. Alternatively, the effluent slurry from autoclave 38 can be flashed directly to lower its temperature. Then the free acid in the pregnant solution can be neutralized with nickeliferous silicate ores. Other neutralizing reagents can be used. The slurry containing the neutralized pregnant solution and the leach residue plus residue resulting from the neutralization processes is subjected to a liquid-solid separation 44 to provide a neutralized pregnant solution and a residue which is sent to waste. The neutralized pregnant solution can be treated to recover nickel, cobalt and any other metal values dissolved therein. Advantageously, the pregnant solution is treated with hydrogen sulfide to precipitate nickel and cobalt values which can then be treated to recover separately the nickel and cobalt.

In order to give those skilled in the art a better appreciation of the advantages flowing from the practice of the present invention the following illustrative examples are given:

EXAMPLE I

In a series of three tests, a nickeliferous oxide containing, by weight, 1.07% nickel, 0.10% cobalt, 3.6% aluminum, 47.0% iron and 0.7% magnesium was formed into a slurry containing 43% solids by weight. The slurry was preheated to a leaching temperature of 270° C by the direct addition of steam. The preheated slurry was fed at a rate of 550 liters per hour to the first autoclave of a train of five autoclaves with a total working volume of 630 liters. Each of the autoclaves was equipped with a titanium impeller which was rotated at 1200 revolutions per minute (rpm).

The three tests were conducted to show how scaling can be controlled by the incremental addition of acid for approximately the same additions. In the first test, Test A, sulfuric acid in an amount equivalent to 0.2 part per part of dry ore was in a single stage in the first autoclave. In Tests B and C the acid was added incrementally as shown in Table I. The nickel extractions and the scaling rates encountered in Tests A, B and C are shown in Table II. Also shown in Table II is the relative operating time which can be obtained before the leach train should be shut down for descaling. The relative operating time is calculated by dividing the highest scale rate experienced in any vessel in each test by the highest scaling rate experienced in any vessel in any test (the first autoclave in Test A in this Example I).

TABLE I

| TEST | Acid to Ore Ratio | Acid Distribution, % 1st Vessel | 2nd Vessel | 3rd Vessel |
|---|---|---|---|---|
| A | 0.20 | 100 | 0 | 0 |
| B | 0.24 | 67 | 17 | 16 |
| C | 0.23 | 50 | 25 | 25 |

TABLE II

| Test | Scaling Rate, in/mo 1st Vessel | 2nd Vessel | 3rd Vessel | Relative Leach Train Operating Time, % | Ni Extraction % |
|---|---|---|---|---|---|
| A | 1.80 | 1.50 | 0.20 | 100 | 97 |
| B | 1.21 | 0.46 | 0.15 | 149 | 97 |
| C | 0.81 | 0.37 | 0.11 | 222 | 97 |

The foregoing tests confirm that the combination of incremental acid addition, vigorous stirring and high temperatures cooperate to provide low scaling rates and high nickel extractions at commercially attractive rates. The relative operating times show that incremental acid addition can increase the production runs significantly before the autoclave train must be shut down for descaling

EXAMPLE II

Another series of three tests were conducted on a nickeliferous oxide ore containing, by weight, 1.8% nickel, 0.15% cobalt, 2.8% aluminum, 42% iron and 1.7% magnesium to show the effect of aluminum and/or iron contents on scale formation.

The ore was slurried with water and preheated to 270° C as described in Example I. The preheated slurry was fed to the same autoclave train which was operated in the same manner as described in Example I.

The amount of acid fed to the autoclaves and the manner in which it was distributed among the first three autoclaves in the train are shown in Table III.

TABLE III

| Test | Acid to Ore Ratio | Acid Addition, Distribution, % 1st Vessel | 2nd Vessel | 3rd Vessel |
|---|---|---|---|---|
| D | 0.22 | 50 | 50 | 0 |
| E | 0.22 | 70 | 15 | 15 |
| F | 0.22 | 50 | 25 | 25 |

The scaling rates encountered in each of the vessels for each test are shown in Table IV together with the relative leach train operating time and the nickel extractions obtained.

TABLE IV

| Test | Scaling Rate, in/mo 1st Vessel | 2nd Vessel | 3rd Vessel | Relative Leach Train Operating Time, % | Ni Extraction, % |
|---|---|---|---|---|---|
| D | 0.37 | 0.84 | 0.37 | 100 | 95 |
| E | 0.85 | 0.73 | 0.40 | 100 | 96 |
| F | 0.41 | 0.57 | 0.33 | 148 | 95 |

Samples of the leach solution were taken from each of the first three autoclaves in the train for each test and were analyzed for their iron and/or aluminum contents. These results are reported in Table V.

TABLE V

| Test | 1st Vessel Al* | Fe* | 2nd Vessel Al* | Fe* | 3rd Vessel Al* | Fe* |
|---|---|---|---|---|---|---|
| D | 0.5 | 0.3 | 2.2 | 1.3 | 1.2 | 0.6 |
| E | 1.0 | 0.7 | 1.1 | 1.2 | 1.4 | 0.7 |
| F | 0.5 | 0.3 | 0.8 | 0.8 | 1.2 | 1.0 |

*gpl

Comparing the aluminum content of the leach liquor in the first vessel for Tests D, E and F with the scaling rate in these tests confirms that high scaling rates are associated with higher aluminum contents in the leach solution. The same is true for the second and third vessels.

Comparing the scaling rates encountered in the vessels in Tests A, B and E with Tests C and F shows that the detrimental effects of large acid additions persist as the slurry is conveyed from one autoclave to another. Thus, the scaling rate in the second vessel for Test A in which the acid was added all at once in the first vessel was higher than any scaling rate encountered when the acid was added in two or more stages. Likewise, higher scaling rates in the second and third vessels were experienced in Tests B and E in which the initial acid addition was quite high.

Although the present invention has been described in conjunction with preferred embodiments, it is to be understood that modifications and variations may be resorted to without departing from the spirit and scope of the invention as those skilled in the art will readily understand. Such modifications and variations are considered to be within the purview and scope of the invention and the appended claims.

We claim:

1. A process for leaching nickeliferous oxide ore containing at least one metal selected from the group consisting of iron and aluminum which process comprises slurrying the ore with water, preheating the slurry to a leaching temperature between about 230° C and about 300° C, vigorously agitating the preheated slurry, and incrementally adding sulfuric acid to the preheated slurry to maintain the amount of said metal in solution at a value of less than about 4 grams per liter throughout the process, whereby nickel values are rapidly leached while scale formation is minimized.

2. The process as described in claim 1 wherein the nickeliferous oxide ore is a silicate ore and the total amount of sulfuric acid added to the preheated slurry is between about 0.45 part and about 0.8 part per part of dry ore.

3. The process as described in claim 1 wherein leaching is conducted in five stages and between about 50% and about 70% of the total amount of acid is added during the first stage of leaching, between about 10% and about 20% is added during the second stage and between about 10% and about 50% during the third leaching stage.

4. The process as described in claim 3 wherein the acid added to the first, second and third stages is changed during the production run to provide a more uniform scale thickness on the vessel wall of each stage whereby the length of the production run is extended.

5. The process as described in claim 1 wherein the nickeliferous oxide ore is a limonite and the total amount of sulfuric acid added to the preheated slurry is between about 0.15 part and about 0.45 part per part of dry ore.

6. The process as described in claim 5 wherein leaching is conducted in five stages with between about 40% and about 60% of the total sulfuric acid being added during the first stage, between about 20% and about 30% being added during the second stage and between about 10% and about 40% during the third stage.

7. The process as described in claim 6 wherein the acid added to the first, second and third stages is changed during the production run to provide a more uniform scale thickness on the vessel wall of each stage whereby the length of the production run is extended.

8. The process as described in claim 1 wherein the nickeliferous limonitic ore is a blend of silicate and limonitic ores and the total amount of sulfuric acid added to the preheated slurry is between about 0.15 part and about 0.8 part per part of dry ore.

9. The process as described in claim 8 wherein leaching is conducted in five stages with between about 40% and about 70% of the total sulfuric acid being added to the first stage, up to about 30% of the total being added to the second stage, and the remainder of the acid being added to the third stage.

10. The process as described in claim 9 wherein the acid added to the first, second and third stages is changed during the production run to provide a more uniform scale thickness on the vessel wall of each stage whereby the length of the production run is extended.

11. The process as described in claim 1 wherein the sulfuric acid is added to the preheated slurry such that the aluminum content of the leach solution is maintained below about 1 gram per liter.

12. The process as described in claim 1 wherein high magnesia nickeliferous ore is added to the leach slurry to neutralize remaining free acid.

13. The process as described in claim 1 wherein the slurry is preheated to the leaching temperature by the injection of steam.

14. The process as described in claim 1 wherein the slurry is preheated to the leaching temperature by indirect heat exchange.

15. The process as described in claim 1 wherein the preheated slurry is vigorously agitated during the incremental addition of acid to minimize the volume of slurry in contact with high acid concentration, and to provide high surface area to facilitate precipitation of iron and aluminum from solution.

16. The process as described in claim 1 wherein the slurry is heated to a leaching temperature between about 250° C and about 300° C.

* * * * *